United States Patent [19]

Gertsch

[11] Patent Number: 4,505,494

[45] Date of Patent: Mar. 19, 1985

[54] RELEASE TYPE SKI BINDING

[75] Inventor: Ulrich Gertsch, Interlaken, Switzerland

[73] Assignee: TMC Corporation, Baar, Switzerland

[21] Appl. No.: 333,531

[22] Filed: Dec. 22, 1981

[30] Foreign Application Priority Data

| | | | |
|---|---|---|---|
| Dec. 30, 1980 | [CH] | Switzerland | 9635/80 |
| Oct. 19, 1981 | [CH] | Switzerland | 6650/81 |
| Dec. 18, 1981 | [CH] | Switzerland | 8049/81 |

[51] Int. Cl.[3] ..... A63C 9/085

[52] U.S. Cl. ..... 280/618; 280/629

[58] Field of Search ..... 280/618, 633, 620, 628, 280/629, 630, 631, 632, 635, 617

[56] References Cited

U.S. PATENT DOCUMENTS

| | | | |
|---|---|---|---|
| 3,558,150 | 1/1971 | Marker | 280/635 |
| 3,667,770 | 9/1972 | Lawrence | 280/636 |
| 3,930,661 | 1/1976 | Marker | 280/618 |
| 3,951,424 | 3/1976 | Naepflin | 280/618 |
| 3,966,218 | 6/1976 | Beyl | 280/618 |
| 4,003,587 | 1/1977 | Salomon | 280/618 |

FOREIGN PATENT DOCUMENTS

| | | | |
|---|---|---|---|
| 231874 | 2/1964 | Austria | 280/629 |
| 245448 | 2/1966 | Austria . | |
| 289617 | 9/1970 | Austria | 280/630 |
| 296111 | 5/1971 | Austria | 280/631 |
| 302126 | 1/1972 | Austria | 280/618 |
| 1229429 | 11/1966 | Fed. Rep. of Germany | 280/635 |
| 2163892 | 6/1973 | Fed. Rep. of Germany | 280/630 |
| 2827717 | 1/1979 | Fed. Rep. of Germany . | |
| 2838458 | 3/1979 | Fed. Rep. of Germany | 280/618 |
| 1423782 | 11/1965 | France | 280/629 |
| 190870 | 8/1964 | Sweden | 280/629 |

*Primary Examiner*—David M. Mitchell

*Attorney, Agent, or Firm*—Flynn, Thiel, Boutell & Tanis

[57] ABSTRACT

This invention relates to a release type ski binding comprising a heel retainer means and a toe retainer means between which a release plate or a ski boot sole extends, the toe retainer means having connected thereto a foot plate extending under the boot sole at least as far as the toe ball portion of the ski boot sole and, when a release movement sidewardly off the running position against the force of a sideways release means provided on the ski takes place, the release plate or the ski boot sole, respectively, being first held against forward movement by a support means and therefore being only pivotable sideward about a pivot point disposed in the heel area, and the foot plate being adapted to slide away from the heel retainer means in the longitudinal direction of the ski when an elastic range has been exceeded, and further comprising a friction-reducing rest means for the pivot motion. Under particular tumbling conditions different reaction forces occur in the ball area of the ski boot and impede the release of the ski boot. Different oriented reaction forces are prevented by the fact that exclusively the foot plate is directly supported by the rest means with a view to the pivoting and sliding motions.

15 Claims, 16 Drawing Figures

RELEASE TYPE SKI BINDING

FIELD OF THE INVENTION

This invention relates to a releasable type ski binding.

BACKGROUND OF THE INVENTION

Austrian Pat. No. 355 964 reveals a releasable ski binding which comprises a toe retainer mounted on the foot plate, which is designed as a slide, the toe retainer means being laterally pivotable and slidable in the longitudinal direction of the ski together with the slide on a step-on structure or a release plate, respectively, which establishes connection to the pivot point which lies in the heel area. On the underside of the slide a follower member is resiliently mounted which engages a center portion of a control cam of the support means which extends approximately transversely to the longitudinal direction of the ski and by which the elasticity range is defined. From this center portion of the control cam there extend forwardly inclined lateral flanks along which the follower member moves when the elasticity range is exceeded. After release, a spring acting on the follower member causes the toe retainer means together with the slide to slide back in the direction toward the heel retainer means and thereupon the resetting means provided in the heel area pivots the toe retainer means with the foot plate and the release plate back to the running position. Due to the large lever arm between the resetting means and the toe retainer means, resetting is aggravated and proper centering in the running position is difficult. However, the main shortcoming of this release type ski binding resides in the fact that for the step-on structure or the release plate, respectively, a separate rest means fixedly connected to the ski, namely, a portion of the support means is provided and that the step-on structure or release plate forms additional separate rest means for the longitudinally displaceable slide. At this number of spaced rest means the ball pressure force, in particular in case of a torsional tumble with the skier in a forward lean position, causes reaction forces which occur at different locations and can hardly be predicted or controlled and which have an adverse effect on the release behavior of the releasable ski binding especially under these tumbling conditions.

SUMMARY OF THE INVENTION

The primary object underlying the invention is to provide a releasable ski binding of the afore-mentioned type which guarantees safe release even in case of a torsional tumble with the skier in a forward lean position, which causes an extreme loading in the toe ball area.

According to the invention, it is the rest means which is responsible for the reaction force caused by the ball pressure force during lateral pivoting and also during sliding of the foot plate. This reaction force acts exclusively at the foot plate, on which the ski boot exerts the ball pressure force in the ball area. The reaction force is also produced where the ball pressure force is acting, and in any sideways pivoting movement and also in every sliding movement in the longitudinal direction of the ski. The torsional force transmitted by the skier to the foot plate and the thrust directed away from the heel retainer means, which overly the ball pressure force, can clearly overcome the respective reaction force under any tumbling conditions, and in particular in a torsional tumble in which the skier is in a forward lean position. The release behavior is not adversely affected even under aggravated tumbling conditions. The properly controllable reaction force between the foot plate and the rest means is also advantageous with a view to the returning of the toe retainer means together with the foot plate within the elasticity range of the releasable ski binding, since in case of torsional stresses resulting in a lateral pivoting movement of the toe retainer means together with the foot plate without causing actual release, the return operation has to be carried out rapidly and precisely until the running position is reached. In this case, the reaction force, both the magnitude and the site of generation of which are precisely predeterminable, is much easier to control than the reaction forces occurring in the known solution, which have different values and are generated in various locations.

According to a useful embodiment of the invention, in a torsional tumble with or without the skier being in a forward lean position the ski boot bears against the forward portion of the release plate, together with which it conducts both the sideward pivoting movement and the sliding movement. Since the rear portion of the release plate is not under load and in addition is supported by the rest means through the forward portion, reaction forces occur only on the rest means, where they can be readily overcome by the ball pressure force and the torsional or sliding force exerted by the ski boot.

If the release plate is made in one piece and the foot plate is incorporated therein, frictional forces will also occur on the rest means only, so that the sideways pivoting movement and the sliding movement of the entire release plate and also the sideways pivoting movements within the elasticity range can very easily be controlled.

Furthermore, the foot plate is preferably well supported over its entire width by the rest means. Even if the ski boot is twisted during pivoting or sliding, the reaction forces will always occur in the same location as the ball pressure force.

According to yet another useful embodiment of the invention, the foot plate and the toe retainer means are supported in a particularly solid manner.

It is suitable to arrange the two slide strips of the rest means so that the slide strip which is forward in the sliding direction also undergoes the relative movements taking place within the elasticity range and when the binding releases.

According to a further feature, it is important for providing a desired release behavior of the releasable ski binding that the ball pressure force always act on the foot plate in the same location. The actual rest surface of the ski boot is predetermined thereby. When the ski boot rests on the support rail, it is of secondary importance whether some dirt or snow and ice have deposited before or after the support rail.

In yet another useful embodiment, the area in which the ski boot rests on the foot plate is also precisely predeterminable. The rear portion of the release plate remains free of load and is supported by the rest means through the offset portion.

According to still another important feature of the invention in a heel retainer means mounted on the ski which does not partake in the pivoting of the release plate or the rear portion thereof, respectively, there result favorable angle conditions in the heel portion of the ski boot sole when under a torsional stress the ski boot is pivoted with the center of rotation disposed in the heel area. These favorable angle conditions facilitate releasing the ski boot from the heel retainer means, when the elasticity range is exceeded, if this becomes necessary in view of some special tumbling conditions. Conventionally, the heel is held by a sole hold-down means of arcuate configuration provided on the heel retainer means, in which the heel rotates when the ski boot is pivoted about the pivot point in the heel area. Since there the heel retainer means is stationarily mounted on the ski, the heel can easily come free on the side opposite to the side to which the boot pivots in the toe area. When the heel retainer means fixedly mounted on the ski is also designed for lateral release, particularly little resistance is offered to the release of the heel upon a pivot movement beyond the elasticity range in the toe area.

According to still another useful embodiment of a release type ski binding, the gripper means provided on the skid plate of the toe retainer means sees to it that the toe retainer means is always properly aligned with a pivot point in the heel area despite the fact that no controlling release plate is provided, and that the ski boot sole does not rotate relative to the skid plate, as such relative movement would impede proper resetting within the elasticity range, for example. In this case, the ski boot sole itself provides a rigid connection between the toe retainer means and the pivot point, although no release plate is provided. It is possible that way to advantageously use the favorable kinematics of the lateral pivoting with simultaneous sliding movement in the longitudinal direction of the ski.

Due to the fact that there is no direct connection between the toe retainer means and the pivot point, proper centering thereof in the running position and without application of a ski boot would be impossible. Providing spring means avoids this and also avoids flapping or banging of the toe retainer means during transport and it makes it easier to put the releasable ski binding on.

Another useful aspect of the invention takes into account the fact that the release plate needs not take up practically any forces owing to its being fixedly connected to the toe retainer means, on the one hand, and solidly supported at the rotary axis, on the other hand. Furthermore, the space below it is not occupied by any disturbing elements, but it can rest either directly on the upper surface of the ski or on sliding elements embedded into this surface, whereby the amount of bending stresses occurring in the release plate is negligible.

According to another useful embodiment, despite the fact that the resetting means is arranged on the ski in the path of movement of the toe retainer means or the foot plate, the lateral pivotability and slidability of the toe retainer means in the forward direction is not restricted, since the coupling does not offer resistance to this movement. The support means is primarily responsible for the motion phase during running, i.e. within the elasticity range, and it prevents the toe retainer means and the release plate from moving forwardly in spite of the lateral pivotability within the elasticity range. Once the elasticity range is exceeded, the toe retainer means can either escape in the forward direction guided by the appropriately designed parts of the control cam, or move forwardly in an altogether feely movable manner, only influenced by the known reaction force between the foot plate and the rest means. The coupling cooperating with the support means effects guidance when the toe retainer means is returned to the running position, with the resetting means acting directly on the toe retainer means via the coupling with a favorable lever arm and pushing the toe retainer means back into the running position in a freely movable manner or again in a guided manner, and pivoting it inwardly. This guidance is designed to be simple and reliable in operation and it can put up with snow or contaminant matter that may have penetrated during the tumbling of the skier without making it necessary to use the hand to effect return. At the same time, the coupling prevents the toe retainer means or the release plate from pivoting sideways in a fully unrestricted manner, which would incur the danger of damaging the mechanism.

If in a further useful embodiment, a lateral release means permanently operatively connected to the toe retainer means through the coupling facilitates the resetting function of the resetting means, a particularly useful and safely operating structure is achieved. The lateral release means which in this embodiment is provided on the ski before the toe retainer means does not impede the free movability of the toe retainer means because of the fact that the coupling has a certain amount of play.

According to another useful embodiment, the control element relieves the release means from forces acting in the longitudinal direction of the ski, whereby the designing of the release means is simplified.

According to other useful features, the entire region below the ski boot sole or the foot plate, respectively, remains free of elements responsible for release or resetting. If a release plate is provided, this plate can be made to be lightweight and of little height, which is to the benefit of the manufacturing cost and whereby it is avoided that the ski boot sole is positioned at an unfavorable distance above the upper surface of the ski.

According to yet another useful embodiment, the control cams slide or roll along each other within the elasticity range and through release they can lose contact with each other. In resetting, the control cams need not necessarily contact each other, but the toe retainer means is pushed and pivoted back to the running position by the resetting means in a freely movable manner. In this embodiment, the control cams are accommodated in an unexposed location. Also, owing to the fact that the toe retainer means and the release means engage into each other, a reduction in the overall length in the longitudinal direction of the ski is obtained.

According to a further feature, the coupling can be made of parts which are reliable in operation and easy to manufacture and which do not require any extra space in the coupling area of the two elements. The coupling has to transmit the holding force of the release means to the toe retainer means primarily in the elasticity range, so that in the portion of the release means which is responsible for this range the pin is suitably guided in an easy fitting sliding engagement. In the portion engaged by the pin in the release operation the slot can be appreciably flared such that play is possible in this portion not only in the longitudinal direction of the ski, but also sideways therefrom, this being useful for unimpeded release and proper resetting also in the presence of contaminant matter. In this case, the slot could have a V-shaped configuration with a flared end portion, viewed from above.

According to another useful embodiment, the support means does not have a portion fixedly connected to the ski, but support is only effected directly between the housing of the lateral release means and the toe retainer means.

In this embodiment a further feature ensures that support takes place substantially in a torque-free manner, since the thrust forces act at exactly the same level as the support forces. Besides, neither contaminant matter nor snow or ice will deposit in the elevated region.

According to another useful embodiment, the retainer means releases the ski boot at the front end thereof, when the skier tumbles backward, without damaging the foot plate.

A further feature is also important to effect upwardly directed release when the skier tumbles backward, as otherwise the release plate could be damaged under this tumbling condition.

BRIEF DESCRIPTION OF THE DRAWINGS

A description of several embodiments of the subject matter of the invention is given hereinafter in conjunction with the drawings in which.

DETAILED DESCRIPTION

Figures 1, 2, 3:
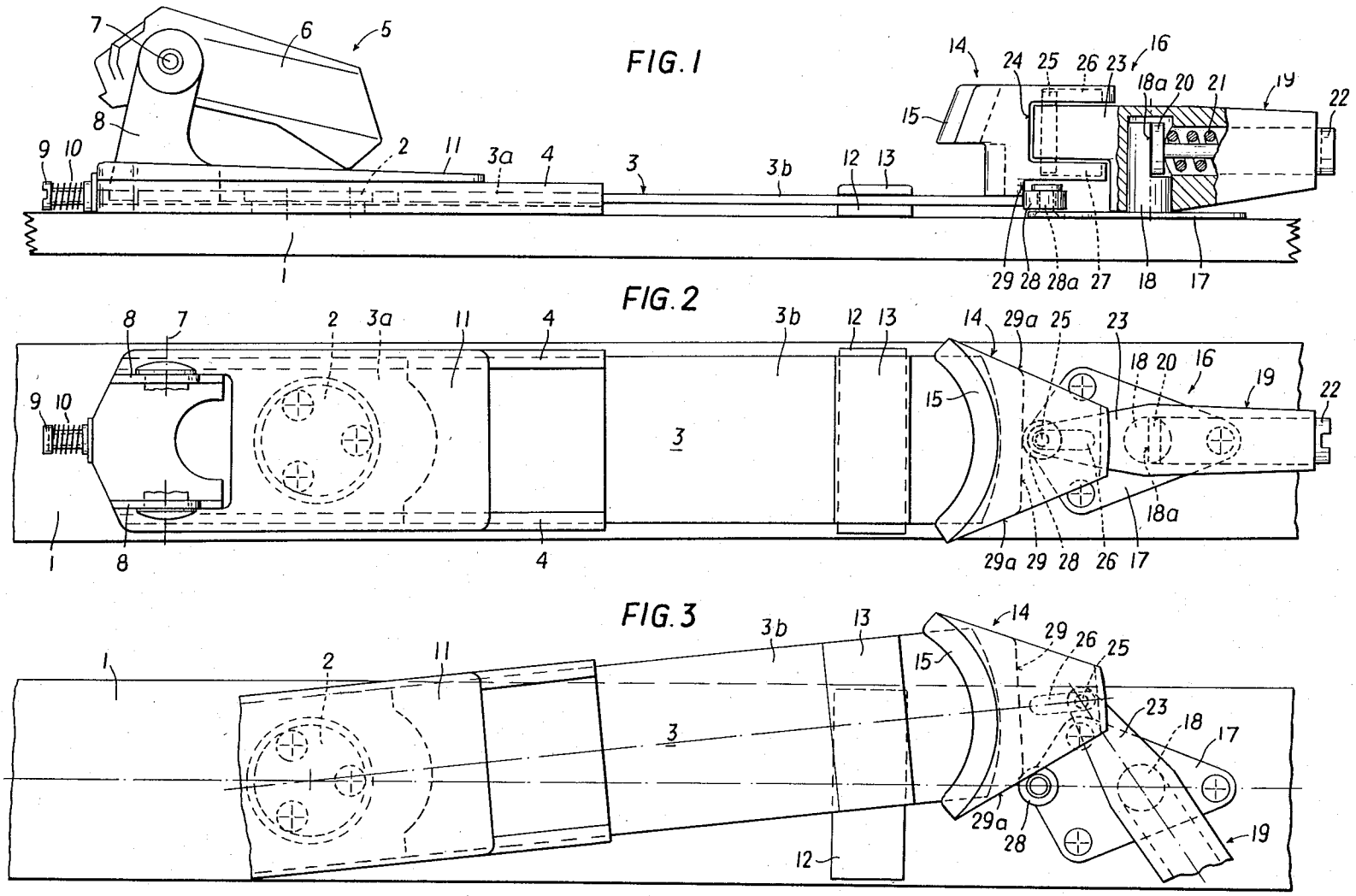
FIG. 1 is a side elevation, partly in section, of a first embodiment of a releasable ski binding.
FIG. 2 is a top view of the releasable ski binding of FIG. 1.
FIG. 3 is a top view of the releasable ski binding of FIGS. 1 and 2, laterally pivoted to the end of the elasticity range.

In FIGS. 1 to 3, a release plate 3 is pivotally supported on a ski 1 by a cylindrical pivot pin or disk 2 fixedly mounted to the ski. The pivot pin 2 forms a pivot axis for the release plate 3 disposed in the heel area of the releasable ski binding. The release plate 3 is not adapted to be lifted off the ski. It consists of two portions 3*a* and 3*b*, portion 3*a* having upwardly bent side edges which serve as guide members 4 for guiding the forward plate portion 3*b*, which is longitudinally slidable relative to portion 3*a*. On portion 3*a* a heel retainer means is mounted which comprises a pin 7 which extends transversely to the longitudinal axis of the ski and supports a pivotable sole hold-down member 6 on a carrier 8 which is longitudinally slidable on portion 3*a*. An adjusting screw 9 enables adjustment to the length of the ski boot sole. A longitudinal equalization spring 10 exerts a forwardly directed pressure on the ski boot. A cover plate 11 is disposed on portion 3*a* for covering the release plate 3 in the heel area.

Portion 3*b* forms a foot plate for the toe ball portion of a ski boot and it rests on a rest means which is in the form of a strip 12 with good sliding properties disposed on the upper surface of the ski. The foot plate carries on its upper surface a transversely extending support rail 13 for supporting the ski boot sole. At the forward end of portion 3*b* a toe retainer means 14 is fixedly mounted which overlaps the ski boot sole with a sole hold-down member 15. The toe retainer means 14 is coupled with a lateral release means 16 mounted on a base plate 17 provided on the ski. The base plate carries a rotary pin 18 which has a flattened portion 18*a* on the side thereof facing away from the toe retainer means 14 and which carries in a laterally pivotable manner a housing 19 containing a piston 20. A compression spring 21 forces the piston 20 against the flattened portion 18*a*. The contact pressure exerted by the piston can be adjusted by an adjusting screw 22.

The housing 19 has a coupling portion or release member portion 23 which engages in a recess 24 in the toe retainer 14 for free lateral pivoting movement. In the coupling portion 23 there is provided a pin 25 which has projecting upper and lower ends engaging in guide slots 26 and 27 provided in the toe retainer means 14. The slots 26 and 27 are designed such as to permit play of the pin 25 in the longitudinal direction of the ski. The base plate 17 has further secured thereto an abutment roller 28 defining a follower member, the abutment roller 28 being rotatable about a pin 28*a* and adapted to be placed in contact with a control cam 29 provided on the toe retainer means 14 or the forward end of portion 3*b*, respectively.

The lateral release means 16 maintains the release plate 3 and the toe retainer means 14 in the running position (FIGS. 1 and 2). The longitudinal equalization spring 10 forces the ski boot against the toe retainer means 14 with a certain force such that the control cam 29 engages the abutment roll 28 and the toe retainer means is prevented from moving in the forward direction.

The release type ski binding functions as follows:

When the skier tumbles forwards, the toe retainer means remains in engagement with the abutment roller 28 and the heel retainer means 5 releases. When lateral pivoting forces act on the release plate 3 (torsional tumble), the release plate 3 can pivot together with the toe retainer means 14 within the elastic range. In this embodiment, the elastic range is defined by a pivot angle of about 5° to either side. After lateral pivoting within the elastic range, the lateral release means 16 returns the toe retainer 14, the foot plate and, via the latter, the release plate 3 to the running position, there being always maintained contact between the control cam 29 and the abutment roller 28.

When the laterally acting forces acting on the toe retainer exceed the holding force of the lateral release means 16, the elastic range is exceeded. The control cam 29 disengages from the abutment roller 28, so that portion 3*b* with the toe retainer 14 gets free and moves away from the heel retainer 5 in the longitudinal direction of the plate. The lateral release means 16 does not impede this movement, since the slots 26, 27 permit displacement of the toe retainer relative to the pin 25. Through the movement of the toe retainer 14 away from the heel retainer 5 the ski boot is released. In both lateral pivoting movement and sliding movement the ball pressure force is transmitted to the slide strip 12 via portion 3*b* of the release plate 3, which portion forms the foot plate. Due to the fact that the foot plate moves along with the ski boot, the ski boot always presses onto the support rail 13. No relative movement takes place between the ski boot and the foot plate. FIG. 3 shows the position in which the elastic range limit is reached or exceeded, respectively.

As soon as the ski boot has been released from the foot plate and the toe retainer 14, the lateral release means 16 pivots the release plate 3 back in the direction toward the running position. Theretofore, the control cam is brought into engagement with the abutment roller 28 with one of its lateral, inclined portions 29*a*, so that the toe retainer together with the portion 3*b* is pushed back toward the heel retainer 5. Thereafter the portion of the control cam 29 which extends approximately transversely to the longitudinal direction of the ski moves along the abutment roller 28, until the toe retainer and the portion 3*b* are back in the running position.

Figure 13:
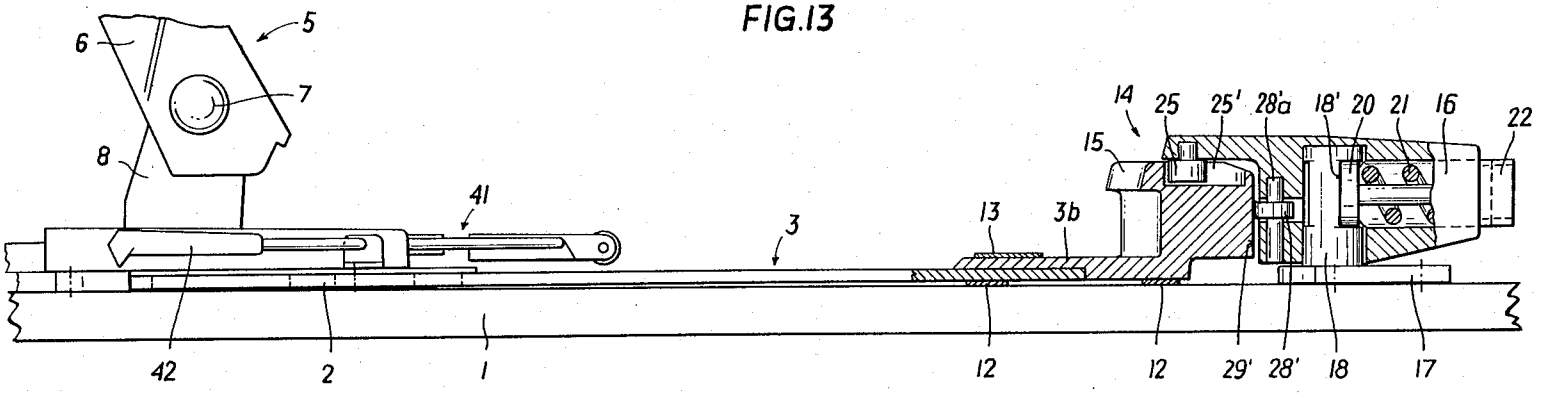
FIG. 13 is a side view, partly in section, of a fifth embodiment of a releasable ski binding.
Figure 14:
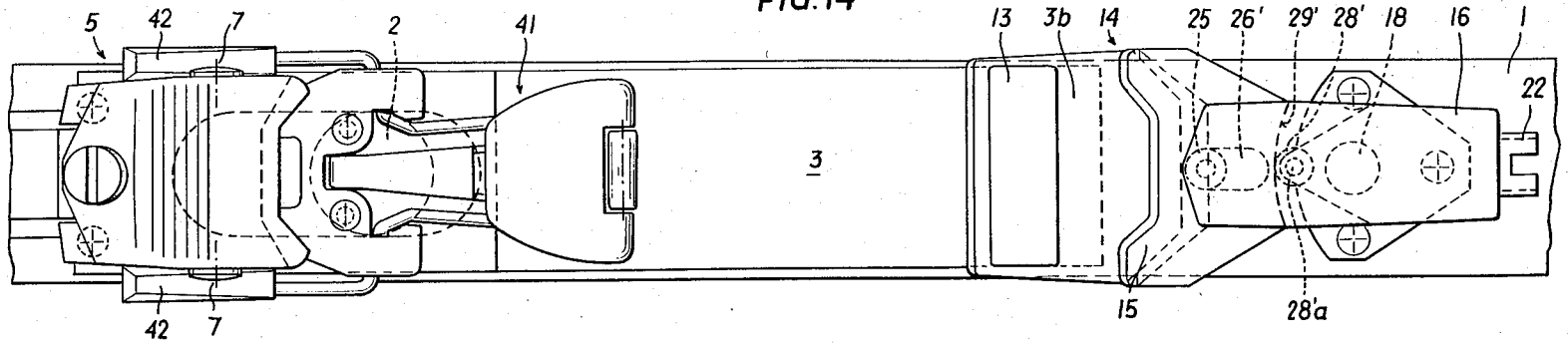
FIG. 14 is a top elevation of the releasable ski binding of FIG. 13.

If a ski brake is connected to the release plate 3, this brake is suitably controlled such that the complete resetting of the release plate and the toe retainer to the running position is a prerequisite for the jumping of the ski brake into its braking position. (FIGS. 13 and 14).

Figure 4:
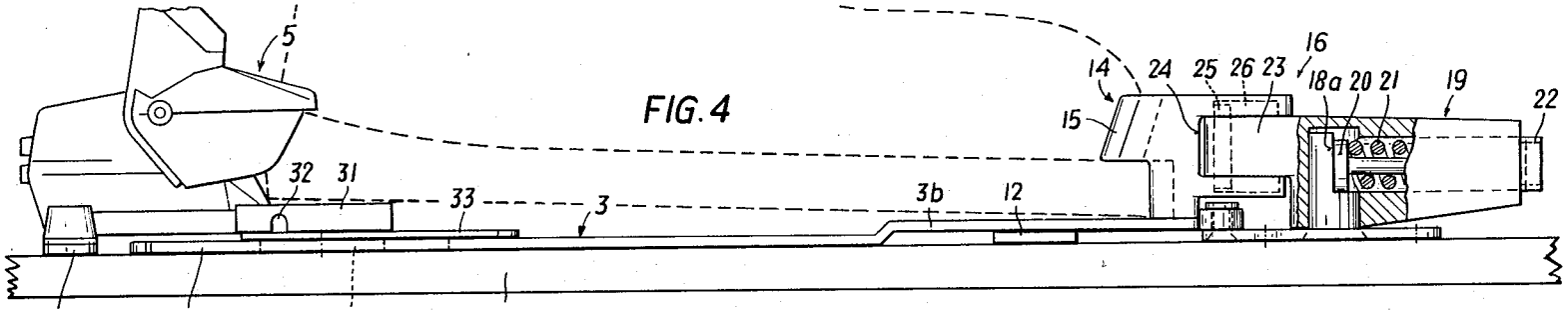
FIGS. 4, 5 and 6 show a second embodiment of a release type ski binding in views respectively corresponding to FIGS. 1–3.
Figure 5:
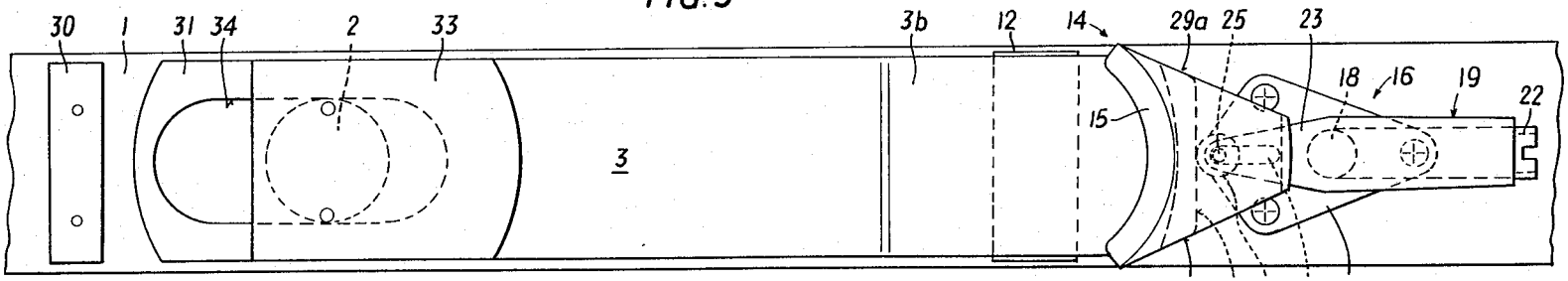
Figure 6:
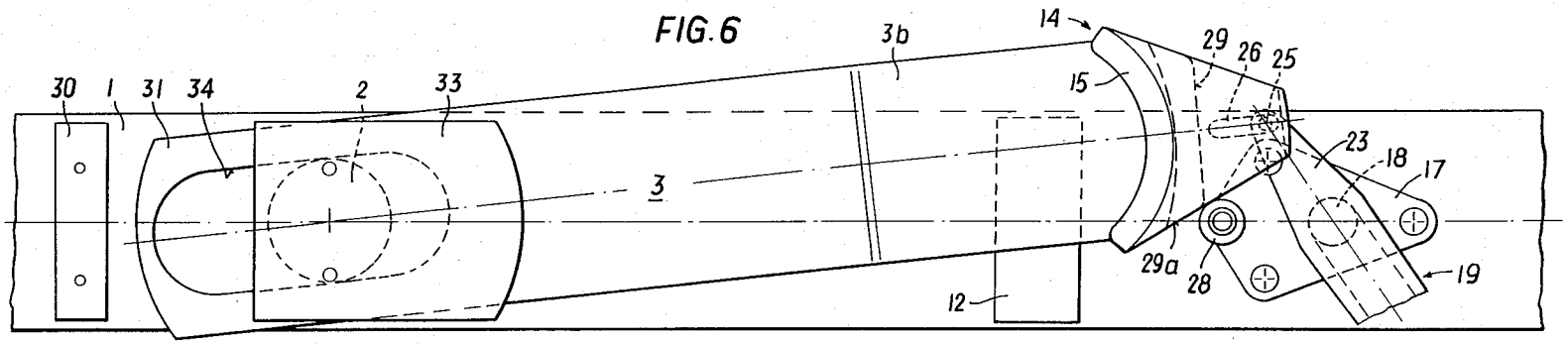

In the embodiment shown in FIGS. 4 to 6, the heel retainer is not disposed on the release plate 3, but it is fixedly secured to the ski by means of a spacer member and is also disposed on the pivot pin 2 of the release plate without impeding the pivotability of the release plate. In this embodiment, the heel retainer means includes means for longitudinal fine adjustment and a longitudinal equalization spring. A heel support plate 31 of the heel retainer means 5 is formed with a channel 32 in which a ski brake can be mounted. At least in the heel area the release plate 3 is covered by a cover plate 33. In this embodiment, the release plate could also be formed of two parts, (FIGS. 1 to 3, but it is made in one piece there. For it to be able to carry out the necessary movement in the longitudinal direction of the ski nevertheless, it is provided with an elongated hole 34 into which the pivot pin 2 extends. The elongated hole 34 also provides compensation for variations in length, which may occur when the ski flexes in use. The forward portion 3*b* of the release plate 3 is upwardly offset and forms the support or foot plate under the toe ball portion of the ski boot. The release plate 3 is supported by a slide strip 12 via the foot plate in this embodiment too.

The position of the pivot pin 2 in the elongated hole 34 can be varied within a particular range, so that the spacing between the heel retainer 5 and the toe retainer 14 can be adjusted to different ski boot lengths by changing the position of the pivot pin 2 and that of the spacer plate 30.

The release type ski binding according to FIGS. 4 to 6 works in the same manner as has been explained in connection with the embodiment of FIGS. 1 to 3, it being possible, however, for the entire release plate 3 to move forwardly relative to the pivot pin 2.

Figure 7:
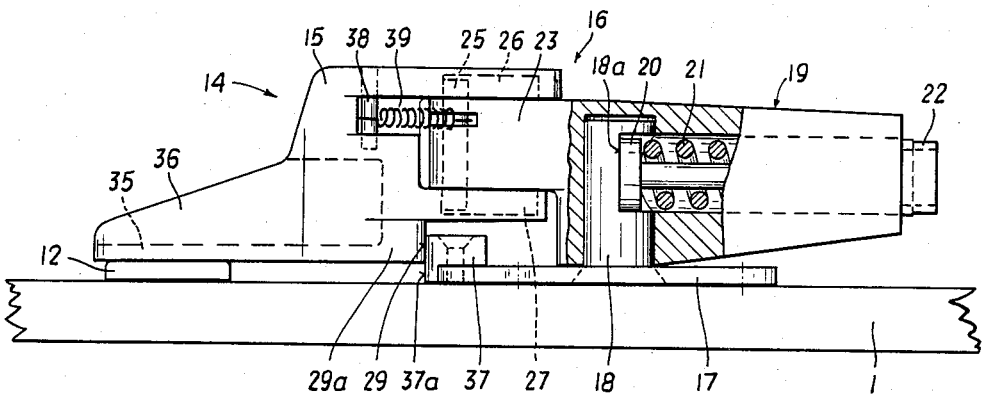
FIG. 7 is a side elevation, partly in section, of a third embodiment of a release type ski binding.
Figure 8:
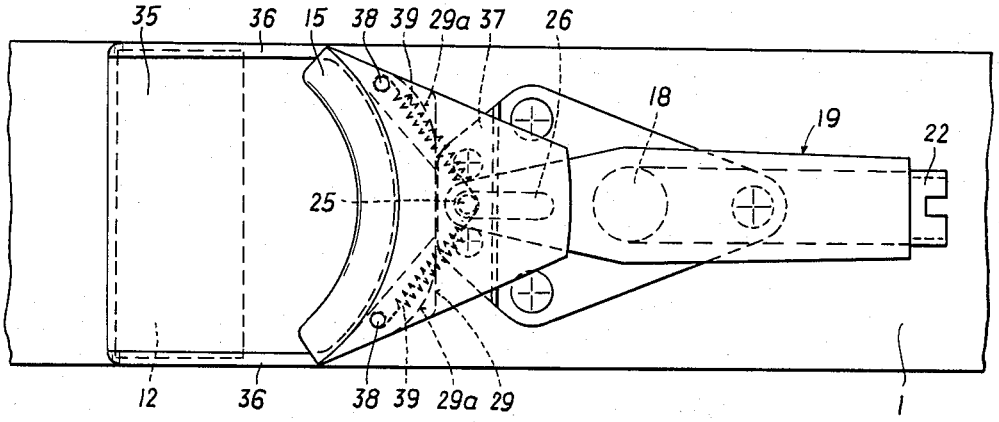
FIG. 8 is a top view of the front portion of the release type ski binding of FIG. 7.
Figure 9:
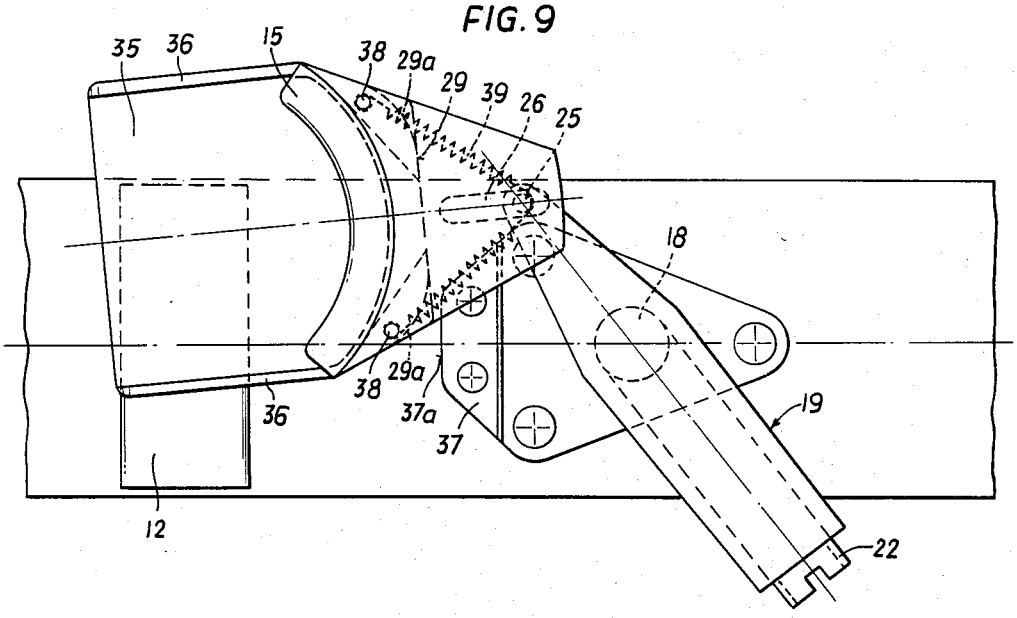
FIG. 9 shows the releasable ski binding according to FIGS. 7 and 8 in a laterally pivoted condition.

In the embodiment according to FIGS. 7 to 9 no release plate is provided, but on the toe retainer 14 there is provided instead a skid plate 35 forming the foot plate, this skid plate resting on the slide strip 12 and extending under the front portion of the ski boot sole. To prevent the skid plate 35 from rotating under the ski boot sole when there occurs a lateral pivoting movement of the ski boot within the elastic range about the pivot point provided by the pivot pin 2, lateral guide jaws 36 forming a gripper means are provided which enclose the ski boot sole laterally between them. In this case, the toe retainer means 14 is also coupled with a lateral release means 16 by which it is maintained in the running position. For centering the toe retainer in the running position, there is provided, instead of an abutment roller 28, a contact member 37 serving as an abutment. This contact member 37 is fixedly mounted on the ski and is provided with a control cam 37*a* which is engageable by the control cam 29 of the toe retainer means 14. Anchored in the toe retainer means 14 are fastening pins 38 to each of which a tension spring is connected whose other end is connected to the pin 25 respectively. The tension springs 39 serve to center the toe retainer means 14 in the running position, this being useful in so far as the movement of the toe retainer means 14 about the pivot point at pin 2 is only controlled when the ski boot in inserted. In this case, the sole partly replaces the release plate.

When the elastic range is exceeded, the control cam 29 is disengaged from the control cam 37*a* so that the toe retainer 14 can move forwardly away from the heel retainer. As a result of this movement the ski boot can release in the heel area from the heel retainer and, thus, from the ski binding. Upon release of the ski boot, the lateral release means 16 returns the toe retainer 14 to the running position and during this operation the toe retainer is automatically pushed back toward the heel retainer as a result of the movement of the lateral control cam portion 29*a* along the control cam 37*a*.

Figure 10:
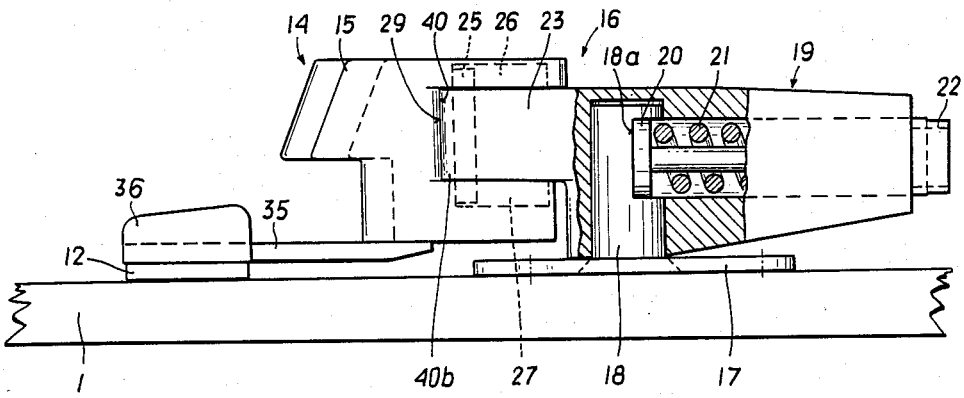
FIGS. 10, 11 and 12 show a fourth embodiment of a release type ski binding in views respectively corresponding to FIGS. 1–3.
Figure 11:
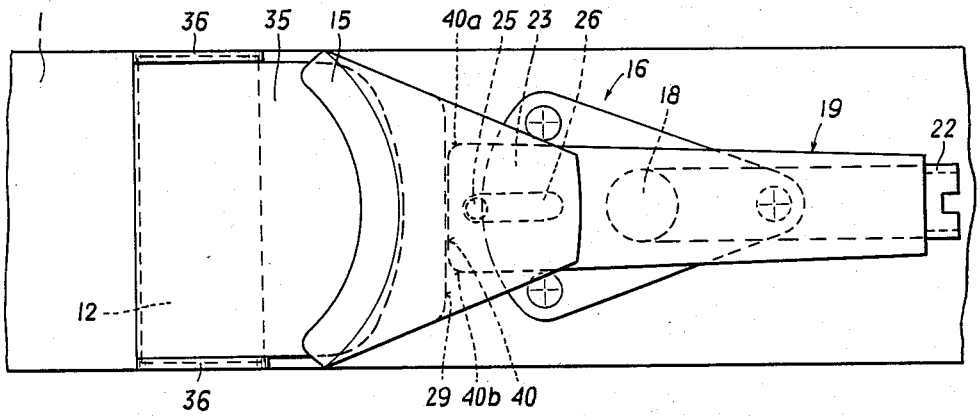
Figure 12:
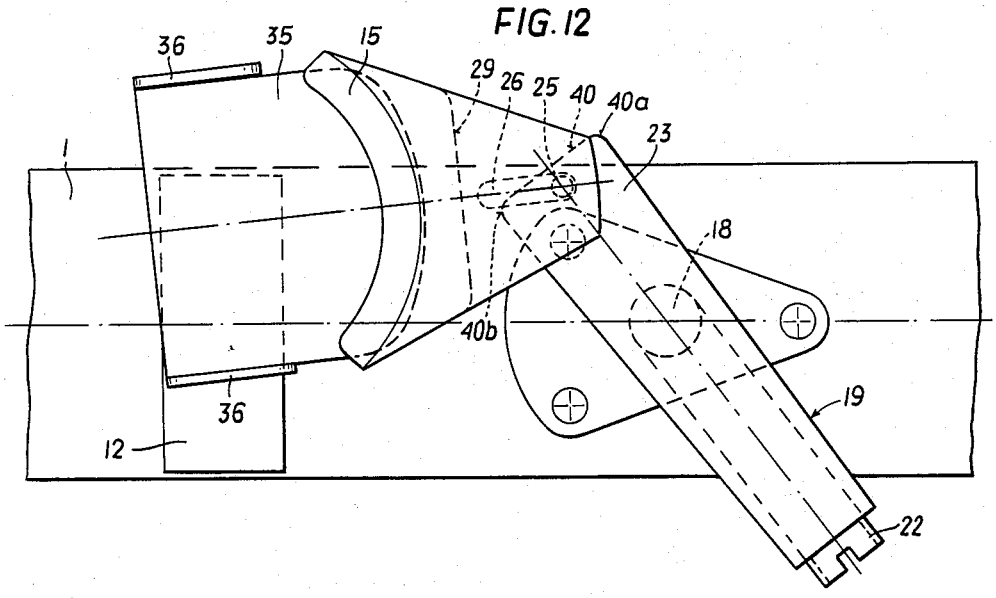

In the embodiment according to FIGS. 10 to 12, the centering of the toe retainer 14 in the running position is not effected by a contact member fixedly mounted on the ski, but by the coupling portion 23 itself. On the front end of the coupling portion 25 which engages into the toe retainer 14 a control cam 40 is provided which cooperates with the control cam 29 provided on the toe retainer 14. At both ends of the control cam 40 there are provided curved control cam sections 40*a* and 40*b* respectively.

Since the control cams 40 and 29 are substantially rectilinear and extend transversely to the longitudinal direction of the ski, one of the end sections 40*a* or 40*b* engages the control cam 29 at the limit of the elastic range, whereby the toe retainer 14 is slightly shifted toward the heel retainer. During resetting within the elastic range the lateral release means 16 is supported in its action by the toe retainer 14 which is pushed forward by the ski boot more vigorously due to the heel thrust.

When a torsional tumble occurs, no matter whether the skier is in a forward lean position or not, the contact between the control cam 29 and the control cam 40 ceases when the elastic range is exceeded, so that the toe retainer 14 moves forward. Thereby the ski boot is released in the heel area. Upon release of the ski boot, the lateral release means effects return of the toe retainer 14 to the running position. In the course of this return movement one of the end sections 40*a* or 40*b* of the control cam 40 can get into engagement with the control cam 29, this resulting in a shift of the toe retainer 14 in the direction toward the heel retainer. The dynamic resetting momentum of the release means 16 and the coupling can result in that the control cams do not constantly engage each other during resetting, but contact is only established towards the end, i.e. just before the running position is reached.

The embodiment according to FIGS. 13 and 14 differs from those described above in that firstly, a ski brake 41 with braking wings 42 is provided adjacent the heel retainer 5. The ski brake 41 is brought into its retracted position by the application of pressure exerted by the ski boot and it is released to assume the operative braking position either automatically after removal of the ski boot or in dependence upon the movement of the release plate 3 when the toe retainer 14 is shifted away or back. Secondly, the support or abutment means and the coupling are differently designed in this embodiment. For coupling there is provided a pin 25 which is mounted in a portion of housing 16 overlapping the toe retainer 14 and which has an enlarged head slidably extending into a longitudinal slot 26' provided in the top of the toe retainer 14. In this support arrangement, which is disposed at a higher level, the front side of the toe retainer 14 is again provided with a control cam 29' which has a slightly concave configuration and in the housing 16 of the lateral release means a roller 28' with semiaxes 28'a is rotatably supported which constitutes the follower member running along the control cam 29'. When the release plate 3 is pivoted sideward about the rearwardly positioned pivot point 2, the control cam 29' pivots about the pivot pin 18 with a different radius than the roller 28', which is pivoted together with the housing 16, so that eventually the limit of the elastic range is reached at which the roller 28' gets beyond an end of the control cam 29'. The control cam 29' is extended on the sides of the toe retainer 14 by sloping flanks by which the toe retainer 14 moves laterally past the roller 28' as soon as the release phase is reached. This movement is enabled by the coupling 25, 26, through which the return movement to the running position is effected also. To this end, the roller 28' rolls along one of the flanks, whereby the toe retainer 14 is shifted back together with the release plate 3 in the direction toward the heel retainer 5 before the roller 28' finally reaches the control cam 29 and forces the toe retainer into the running position through the coupling 25, 26. The concave shape of the control cam 29' enhances the centering action in the running position. Furthermore, the foot plate 3b which is incorporated in the release plate 3 is supported on the ski in a low-friction manner by means of a rest means consisting of two spaced slide strips 12. The forward slide strip 12 can be embedded in the underside of the foot plate and the rear slide strip can be mounted on the upper surface of the ski. Furthermore, the support rail 13 is provided on the foot plate 3b under the ball area of the ski boot. The release plate 3 is supported by the rest means. It is also adapted to be shifted forwards relative to the pivot axis.

In a modification of the above-described embodiments, it is also possible to design the coupling between the release means 16 and the toe retainer 14 such that during resetting an automatic guidance between the release means and the toe retainer results. In this case, however, it must be seen to it that the principal function of the lateral release means is not adversely affected.

In the embodiments according to FIGS. 1 to 6, the control cam 29 can also be provided on the base plate 17, with the toe retainer 14 or the forward end of the foot plate, respectively, carrying the abutment roller 28. If necessary, there can alternatively be provided two rollers 28 or more to change the characteristic.

In the coupling 25, 26 the pin can also be mounted in the toe retainer 14, in which case the guide slot 26 is to be provided in the coupling portion 23 of the housing 16.

Alternatively, it is possible to design the toe retainer 14 and the release means 16 such that the coupling is positioned on the side of the pivot pin 18 facing away from the toe retainer 14. The support means can also be disposed before the pivot pin 18. In this case, the toe retainer 14 and the release means 16 will pivot in the same sense.

Figure 15:
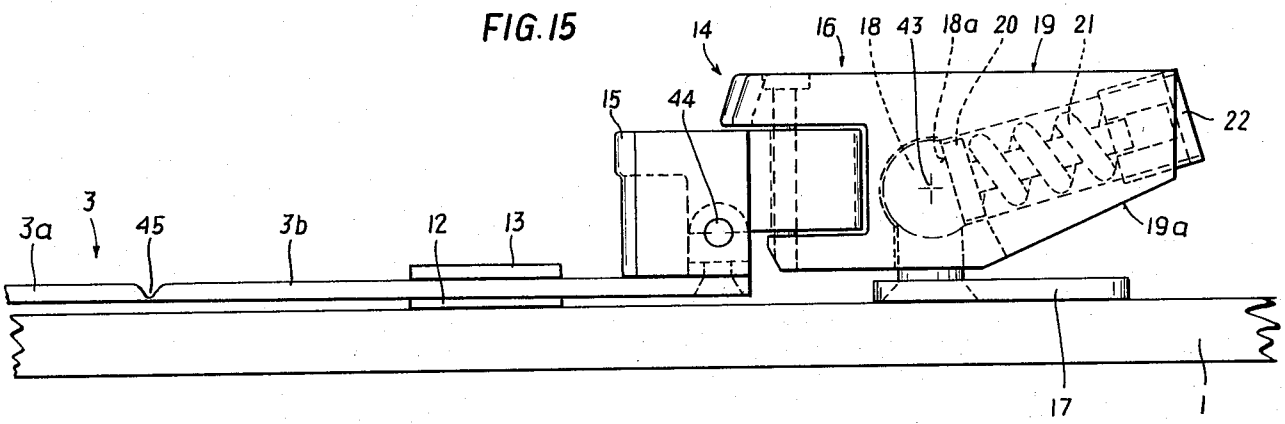
FIG. 15 is a side view of a sixth embodiment of a releasable ski binding in running position.
Figure 16:
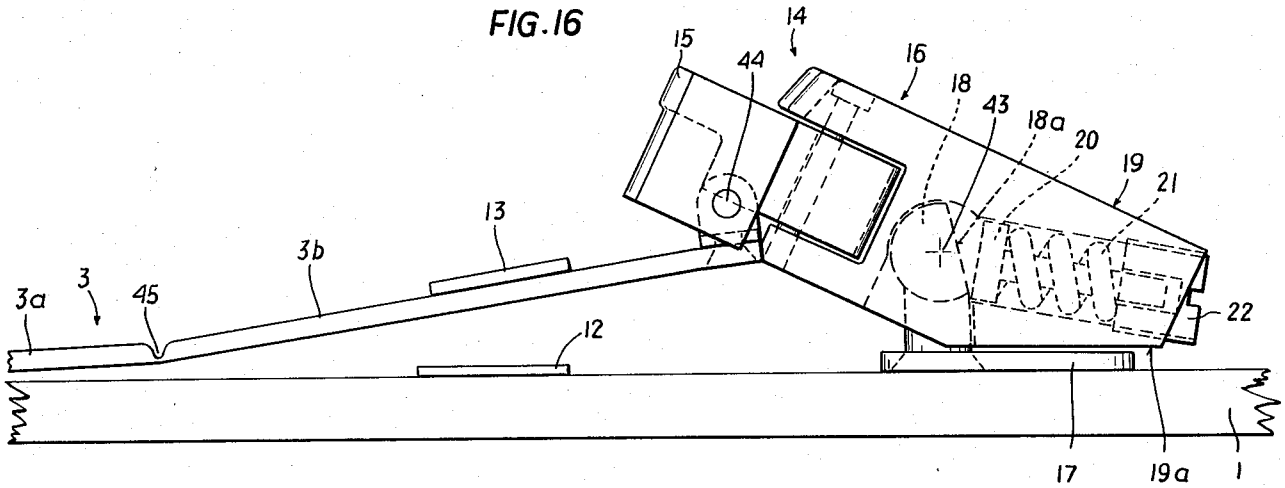
FIG. 16 shows the releasable ski binding of FIG. 15 in upwardly releasing position resulting from a backward fall of the skier.

According to FIGS. 15 and 16, it is provided in another embodiment that the release means is designed such that the toe retainer 14 releases the ski boot when the skier tumbles backwardly. In this embodiment, it is useful to hingedly connect the forward portion 3b of the release plate 3 to the rear portion 3a (through hinge 45) so that the foot plate can swing upwardly together with the toe retainer 14 when the skier falls to his back. This hinge axis can also be in the form of an elastic bending zone incorporated in the release plate 3. Pivot axes 43, 44 extending transversely to the longitudinal direction of the ski are provided between the toe retainer 14 and the housing 19 of the lateral release means 16, on the one hand, and the foot plate 3b, on the other hand. In the lower forward portion of the housing 19 a free surface 19a is provided. The pressure surface 18a on the pivot pin is at an inclined orientation, as are the piston 20 and the spring 21. When in a backward tumble an excessive upwardly directed force occurs, the housing 19 together with the toe retainer 14 is tilted from the position shown in FIG. 15 into the position shown in FIG. 16, whereby the ski boot is released at its front end.

To assure that in a lateral release in the toe area the toe retainer 14 is released in an unimpeded manner, it can be useful to make the guide slots 26, 27 flared to both sides at their ends facing toward the pivot pin 18.

It is favorable that in none of the embodiments a component necessary for release and resetting has to be arranged in the area covered by the ski boot or the release plate. Since all components are positioned outside this area, they can be of suitably large and sturdy design, whereby the functioning reliability is improved. Since where a release plate is used, this plate does not require any elements or resetting, the release plate can be made thin and lightweight and, thus, inexpensive. Flexing of the ski that may occur in use have no adverse effects on the release behavior of the releasable ski binding, since such flexing is compensated in that the binding is longitudinally movable either in the toe or heel area.

The embodiments of the invention in which an exclusive property or privilege is claimed are defined as follows:

1. A ski binding adapted to releasably hold a ski boot on a ski, comprising a toe holder which includes a lateral release mechanism having a release member supported for movement generally transversely of the ski and resilient means for yieldably resisting transverse movement of said release member in either direction away from an initial position in which said release member is substantially centered above the ski; a toe retainer which is adapted to engage a toe portion of the sole of the ski boot and is supported on said release member for pivotal movement relative thereto about a vertical first axis; a foot plate coupled to said toe retainer in a manner preventing relative movement of said foot plate and toe retainer in horizontal directions, said foot plate extending under and supporting the toe portion of the ski boot when said toe retainer is engaged therewith; first means for preventing movement of said toe retainer and said foot plate in a forward direction approximately toward the tip of the ski relative to said release member until said release member has moved a predetermined distance in a transverse direction away from said initial position thereof; and second means for facilitating substantially rectilinear movement of said toe retainer and said foot plate in a forward direction approximately toward the tip of the ski relative to said release member when said release member has moved transversely said predetermined distance from said initial position thereof.

2. The ski binding according to claim 1, wherein said release member is supported for pivotal movement about a substantially vertical second axis, wherein said release member has a substantially vertical pin fixedly secured thereon at a location spaced from said second axis, and wherein said second means includes said toe retainer having an elongate slot therein which extends approximately longitudinally of the ski and in which said pin is slidably received.

3. The ski binding according to claim 1, wherein said first means includes a cam surface provided on one of said toe retainer and said release mechanism and a roller provided on the other of said toe retainer and said release mechanism, said cam surface and said roller being in engagement with each other when said release member is in said initial position and until said release member has moved said predetermined distance away from said initial position.

4. The ski binding according to claim 1, wherein said first means includes a cam surface provided on said toe retainer and a cam surface provided on said release member, said cam surfaces extending generally transversely and being in operative engagement with each other when said release member is in said initial position and until said release member has moved said predetermined distance from said initial position.

5. The ski binding according to claim 1, wherein said foot plate is a release plate which extends to a location in the region of a heel of the ski boot, wherein said second means includes said release plate having a slot therein in the region of the heel of the ski boot which extends approximately longitudinally of the ski, and including a pivot member adapted to be secured to the ski in the region of the heel of the ski boot and slidably received in said slot in said release plate.

6. The ski binding according to claim 1, including a release plate having a rear part which is supported for pivotal movement about a vertical second axis and a front part which is supported on said rear part for movement generally radially of said second axis, and wherein said front part of said release plate is said foot plate.

7. The ski binding according to claim 5, including a spacer plate adapted to be mounted on the ski behind said release plate and said pivot member, and a heel holder supported on said spacer plate and said pivot member and movable longitudinally of the ski.

8. The ski binding according to claim 1, including second resilient means cooperable with said release member and said toe retainer for yieldably resisting pivotal movement of said toe retainer relative to said release member away from a center position.

9. The ski binding according to claim 6, wherein said rear part of said release plate is thin, light and flexible.

10. The ski binding according to claim 1, wherein after said release member has moved transversely said predetermined distance from said initial position and said toe retainer and foot plate have thereafter moved forwardly relative to said release member, said first and second means are responsive to movement of said release member back to said initial position under the urging of said resilient means for automatically moving said toe retainer and said foot plate rearwardly and transversely into their original positions.

11. The ski binding according to claim 1, wherein said release mechanism includes means for automatically returning said toe retainer to its original position after a release, and wherein said release mechanism is arranged in front of said toe retainer.

12. The ski binding according to claim 1, wherein said first means includes said toe retainer having on a side thereof which faces said release mechanism a first control element which, when said release member is in said initial position and until said release member has moved said predetermined distance from said initial position, engages a second control element which is provided on one of said release mechanism and the ski.

13. The ski binding according to claim 12, wherein said release mechanism includes a housing having a coupling portion at an end thereof which faces said toe retainer, said coupling portion being said release member and having thereon a cam which is said second control element, and wherein said first control element on said retainer is a further cam.

14. The ski binding according to claim 1, wherein said second means includes a slot provided in said toe retainer which, when said toe retainer is in a skiing position, extends generally longitudinally of the ski, and includes a vertical pin which is fixedly secured to said release member and is slidably received in said slot.

15. The ski binding according to claim 1, wherein said toe retainer has on a side thereof which faces away from the ski shoe a cam which operatively engages at least one support member which is provided on said release mechanism when said release member is in said initial position and until said release member has moved said predetermined distance from said initial position, and wherein said cam and said support member are arranged in a plane which is spaced above the upper surface of the ski, in which plane in the skiing position forwardly directed forces are transmitted from said toe retainer to said release mechanism.

* * * * *